US006543930B1

(12) United States Patent
Huang

(10) Patent No.: US 6,543,930 B1
(45) Date of Patent: Apr. 8, 2003

(54) CARD HOLDER CLOCK

(76) Inventor: Hellen Huang, 10931 S. Laconia Dr., Villa Park, CA (US) 92861

( * ) Notice: Subject to any disclaimer, the term of this patent is extended or adjusted under 35 U.S.C. 154(b) by 0 days.

(21) Appl. No.: 09/610,017

(22) Filed: Jul. 5, 2000

(51) Int. Cl.[7] ..... G04B 37/00
(52) U.S. Cl. ..... 368/276; 368/10; 368/277
(58) Field of Search ..... 368/10, 223, 276, 368/277, 278

(56) References Cited

U.S. PATENT DOCUMENTS

| | | | | | |
|---|---|---|---|---|---|
| 4,035,938 | A | * | 7/1977 | Neilsen | 40/68.6 |
| 5,685,543 | A | * | 11/1997 | Garner | 273/148 |
| 5,694,378 | A | * | 12/1997 | Totsuka | 368/223 |
| 5,754,499 | A | * | 5/1998 | Lin | 368/223 |

FOREIGN PATENT DOCUMENTS

| | | | | |
|---|---|---|---|---|
| CH | 661170 | * | 7/1987 | 368/276 |

* cited by examiner

*Primary Examiner*—David Martin
*Assistant Examiner*—Jeanne Goodwin
(74) *Attorney, Agent, or Firm*—Cleveland R. Williams, III

(57) ABSTRACT

This invention resides in a novelty holder clock having unusual and unique features. The card holder clock has a front, nut-like configuration which has a round cavity for receiving a round clock on its front face. The front, nut-like configuration is connected to an elongated circular shaped or round back by first, second and third, spaced apart elongated cylindrical shafts, a second, nut-like configuration with a central round hole passing through it is slidably connected to the first and third cylindrical shafts. The first and third cylindrical shafts pass through two spaced apart round holes in the second, nut-like configuration. A coiled spring passes through the center hole in the second, nut-like configuration and rests on top of the first and third, elongated cylindrical shafts. The second, elongated cylindrical shaft passes through the coiled spring and rests on the bottom of said coiled spring. The coiled spring is anchored to the second, elongated cylindrical shaft by a round or circular hook.

6 Claims, 2 Drawing Sheets

Top View

Side View
(Left & Right)

Bottom

CARD HOLDER CLOCK

BACKGROUND OF THE INVENTION

This invention relates to a cardholder clock which has unusual and unique features. The card holder clock has a front, which contains a clock and has a configuration similar to a metal nut. The front is connected to an elongated circular round back by three spaced apart elongated cylindrical rods. A second metal nut-like configuration with a round hole passing through it is slidably connected to first and third cylindrical shafts. A second cylindrical shaft passes through the round hole in the second metal nut and acts as an anchor for a coiled metal spring which passes through the second nut-like configuration and rests on the top of cylindrical shafts one and three.

The second metal nut is slidably movable along the elongated cylindrical shafts from the front metal nut to the elongated circular back.

The Selco custom time corporation has obtained a copyright for a Nut and Bolt Clock, Reg. No. VAU428-867 which features a front bolt-like configuration with male threads on an elongated shaft. The front bolt-like configuration contains a clock. A back nut-like configuration contains female threads for receiving the male threaded shaft.

As can be determined from the above, there is and ongoing research effort to develop new and novel clocks and devices containing the same.

SUMMARY OF THE INVENTION

This invention resides in a cardholder clock which comprises a front, nut-like configuration that contains a round cavity in the front face thereof for receiving a round clock. First, second and third elongated cylindrical shafts connect the front face thereof for receiving a round clock. First, second and third elongated cylindrical shafts connect the front, nut-like configuration to an elongated circular back. A second nut-like configuration with a centered circular hole passing through it contains two smaller spaced apart circular holes for slidably receiving the first and third elongated, cylindrical shafts, a circular coil rests on top of the first and third cylindrical shafts and is anchored to the second cylindrical shaft by a round shaped hook at one end.

DETAILED DESCRIPTION OF THE INVENTION

Figure 1:
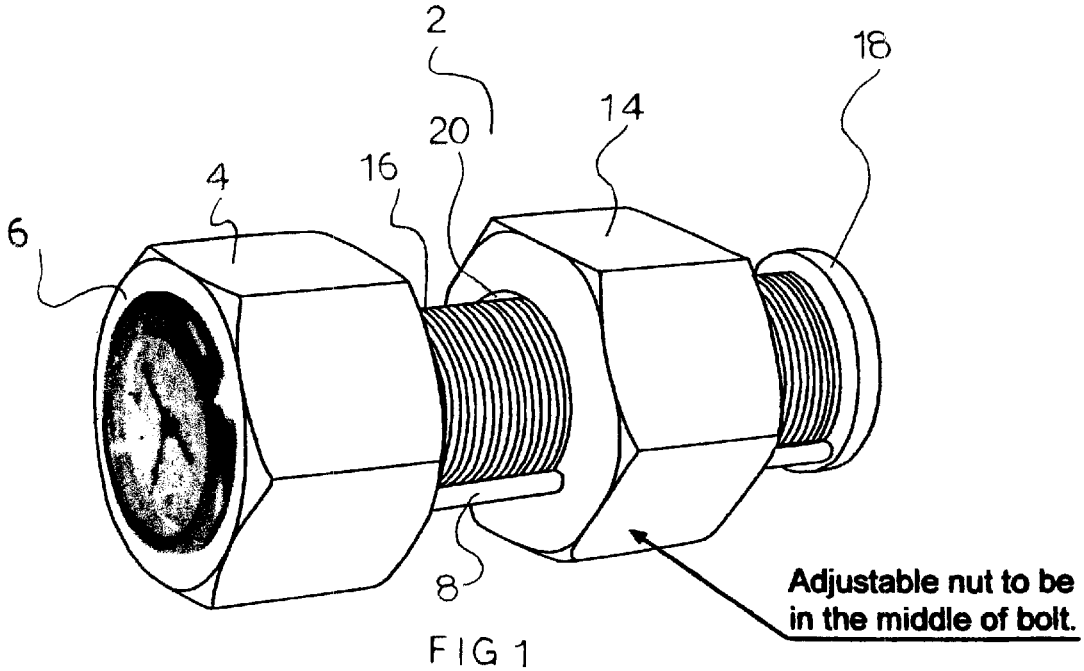
FIG. 1 is a top view of the card holder clock showing the second, nut-like configuration in a middle position.
Figure 2:
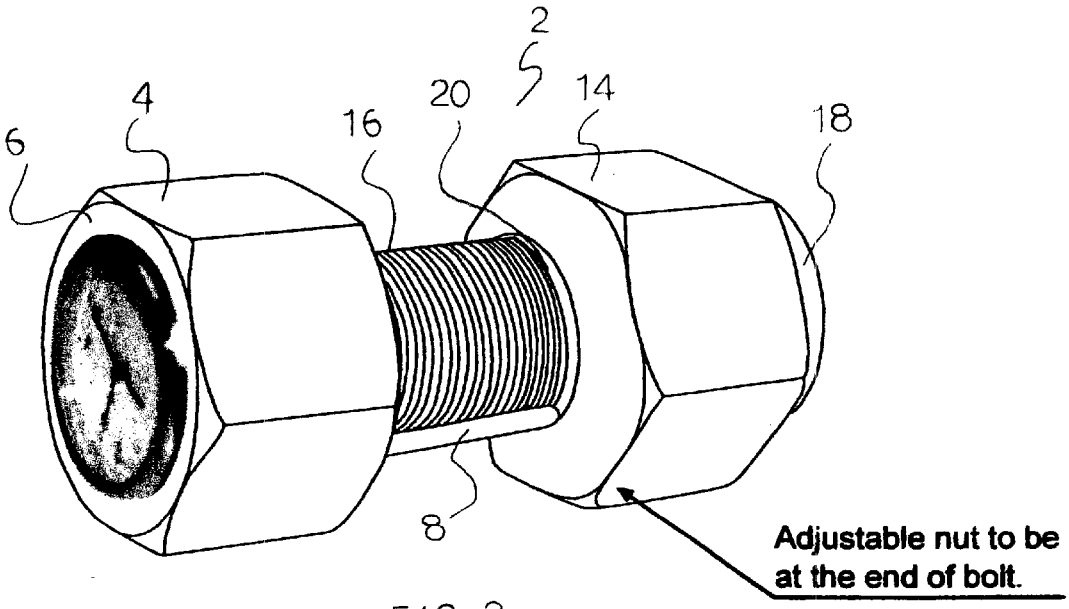
FIG. 2 is substantially the same view of the cardholder clock of FIG. 1 showing the nut-like configuration in an end position.

The present invention resides in a novelty card holder clock which has certain new and innovative features. FIGS. 1 and 2 show a perspective view of the card holder clock 2 herein which shows the relationship of the various elements thereof.

A front nut-like configuration 4, contains a round cavity (not shown) for receiving circular clock 6. Front, nut-like configuration 4 is attached to elongated circular back 18 by first 8, second 10 (not shown) and third 12 (not shown) elongated cylindrical shafts. First 8 and third 12 (not shown) elongated cylindrical shafts slidably pass through two spaced apart holes of second nut-like configuration 14. Second elongated, cylindrical shaft (10) passes through a circular, center hole 20 in second nut-like configuration 14, which is large enough to allow coil like spring 16 to pass through it. Coil like spring 16 rests on the top of elongated cylindrical shafts 8 and 12 and is anchored by a circular hook (not shown) to elongated cylindrical shaft 10 which passes through and rests on the inner bottom portion of coil like spring 16, thus restricting its upward movement. Coil like spring 16 has sufficient distance between the coils to allow business cards and the like to be placed there-between.

The elongated cylindrical shafts are attached to the front and back of the card holder clock by welding or with screws.

FIGS. 1 and 2 show the slideable relationship of second nut-like configuration 14 where it is in a central position in FIG. 1 and in an end position in FIG. 2. It should be noted that the card holder clock herein does not contain male and female screws threads on a bolt-like configuration or in the nut-like configurations 4 and [14] herein.

Figure 3:
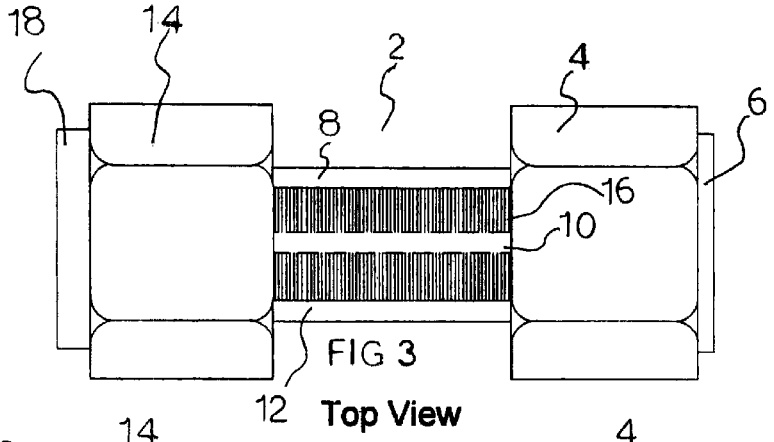
FIG. 3 is a top view of the card holder clock.
Figure 4:
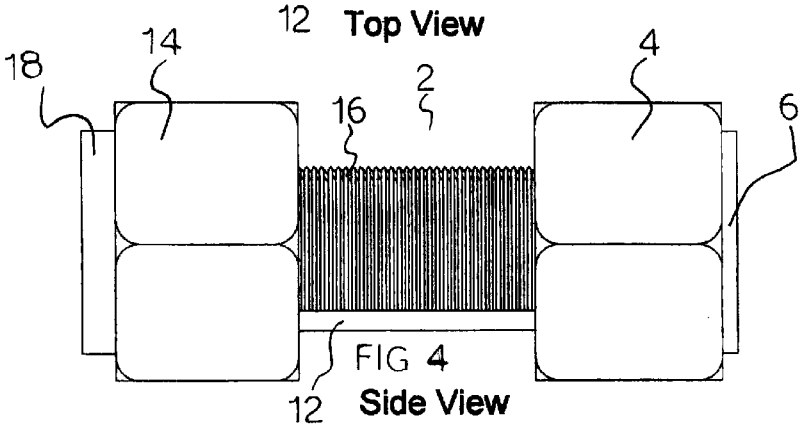
FIG. 4 is a side view of the card holder clock.
Figure 5:
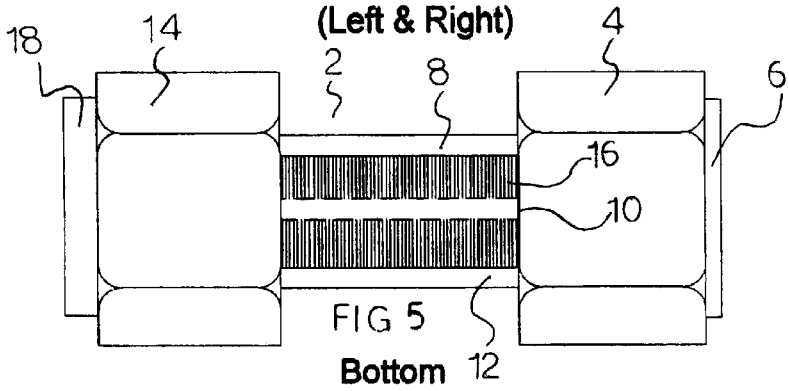
FIG. 5 is a bottom view of the card holder clock.

FIGS. 3, 4 and 5 show top, side and bottom views card of holder clock 2 substantially the same as the views in FIGS. 1 and 2 with the following exceptions. Card holder clock 2 has been rotated 180 degrees in FIGS. 3,4 and 5. The spacial relationship of first 8, second 10 and third cylindrical shafts to front; nut-like configuration 4, second, nut-like configuration 14 and elongated, circular back 18 are shown.

Figure 6:
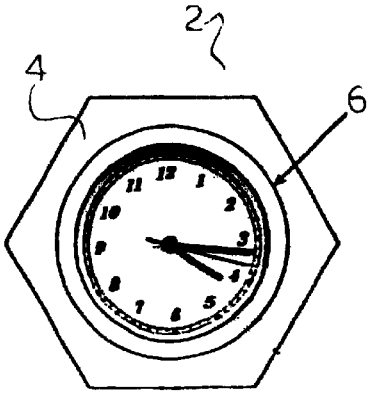
FIG. 6 is a front view of the cardholder clock.

FIG. 6 is a front view of card holder clock 2 showing front, nut-like configuration 4, which contains clock 6.

Figure 7:
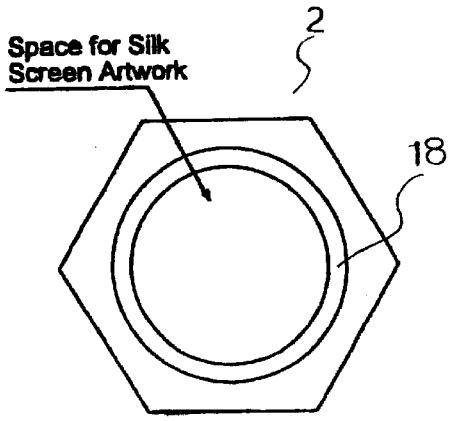
FIG. 7 is a back view of the cardholder clock

FIG. 7 is a back view of card holder clock 2 showing second, nut-like configuration 14 and elongated round end 18. Vacant space 22 receives silk screen artwork or similar indicia.

Obviously, many modifications and variations of the invention, as hereinbefore set forth, may be made without departing from the spirit and scope thereof, and therefore, only such limitations should be imposed as are indicated in the appended claims.

What is claimed is:

1. A cardholder clock comprising:

A front nut-like configuration that contains a round cavity in the front face thereof for receiving a clock, first, second and third elongated cylindrical shafts which connect the front nut-like configuration to an elongated circular back, a second nut-like configuration containing a centered circular hole and two smaller spaced apart circular holes for slidably receiving the first and third elongated cylindrical shafts, a circular coil extending from a back of the front nut-like configuration to a front of the circular back, said circular coil passing through the centered circular hole of the second nut-like configuration resting on top of the first and third cylindrical shafts and being anchored by the second cylindrical shaft, which rests on top of the bottom portion of the circular coil.

2. The Cardholder Clock of claim 1, wherein said cardholder clock does not contain male and female threads on the front nut-like configuration or the second nut-like configuration.

3. The Cardholder Clock of claim 1, wherein the circular coil receives business cards between the coils thereof.

4. The Cardholder Clock of claim 1, wherein the circular coil is anchored to the second cylindrical shaft at one end by a circular shaped hook.

5. The Cardholder Clock of claim 1, wherein the first, second and third cylindrical shafts are connected to the front, nut-like configuration and elongated circular back by welding.

6. The Cardholder Clock of claim 1, wherein the first, second and third cylindrical shafts are connected to the front, nut-like configuration and elongated circular back by screws.

* * * * *